US006747681B1

(12) United States Patent
Desai et al.

(10) Patent No.: US 6,747,681 B1
(45) Date of Patent: Jun. 8, 2004

(54) COMPUTER CONTROLLED INTERACTIVE DISPLAY WITH DUAL CURSOR IMAGE STORAGE FOR A SMOOTH TRANSITION DURING CURSOR IMAGE CHANGE

(75) Inventors: Narendra Maganlal Desai, Round Rock, TX (US); Neal Richard Marion, Georgetown, TX (US); Ashutosh Misra, Bangalore (IN); Raju Bala Showry Pudota, Bangalore (IN); Seetharam Gundu Rao, Bangalore (IN)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/368,682

(22) Filed: Aug. 5, 1999

(51) Int. Cl.[7] ..... G09G 5/00

(52) U.S. Cl. ..... 345/856; 345/157; 345/764; 345/765; 345/861

(58) Field of Search ..... 345/856, 157, 345/764, 765, 859, 861, 522, 538, 562

(56) References Cited

U.S. PATENT DOCUMENTS 4,204,208 A * 5/1980 McCarthy ..... 340/745
4,668,947 A * 5/1987 Clarke, Jr. et al. ..... 340/709
4,764,763 A * 8/1988 Wickstead et al. ..... 340/709
5,321,805 A * 6/1994 Hayman et al. ..... 345/502
5,598,183 A * 1/1997 Robertson et al. ..... 345/145
5,790,134 A * 8/1998 Lentz ..... 345/501
5,796,388 A * 8/1998 Yasuhara et al. ..... 345/168
5,859,651 A * 1/1999 Potu ..... 345/526
5,909,213 A * 6/1999 Martin ..... 345/753
5,995,102 A * 11/1999 Rosen et al. ..... 345/764
6,288,705 B1 * 9/2001 Rosenberg et al. ..... 345/163

FOREIGN PATENT DOCUMENTS

EP 1041484 A2 3/2000 ..... G06F/3/023

* cited by examiner

*Primary Examiner*—John Cabeca
*Assistant Examiner*—Cuong T. Thai
(74) *Attorney, Agent, or Firm*—Jerry B. Kraft; Mark E. McBurney

(57) ABSTRACT

Smoother transitions between changing cursor images which are less stressful to the interactive user of a computer controlled display are provided by apparatus for changing the cursor image, including a frame buffer for storing the display screen image as a pixel array, a separate display buffer for storing the current cursor image as a pixel array, together with apparatus for storing an alternate cursor image as a pixel array during the display of the current cursor image, and means for replacing the current cursor image with the alternate cursor image. In raster scan apparatus for maintaining screen images in the frame buffer on said display screen, there are means for effecting the replacement of said cursor images during a vertical blanking period in said raster scanning.

14 Claims, 4 Drawing Sheets

COMPUTER CONTROLLED INTERACTIVE DISPLAY WITH DUAL CURSOR IMAGE STORAGE FOR A SMOOTH TRANSITION DURING CURSOR IMAGE CHANGE

TECHNICAL FIELD

The present invention relates to user interactive computer supported display technology and particularly to such user interactive systems and methods which are user friendly and minimize user stress related to interactive cursor controlled functions.

BACKGROUND OF RELATED ART

The 1990's decade has been marked by a technological revolution driven by the convergence of the data processing industry with the consumer electronics industry. This advance has been even further accelerated by extensive consumer and business involvement in the Internet over the past few years. There is a need to make computer directed activities accessible to a substantial portion of the population which, up to a few years ago, was computer-illiterate or, at best, computer indifferent. Because of the capability of the computer to make all technological and professional functions more efficient and quicker, workers skilled in various technologies and professions, but of relatively low computer skills, must perform functions with the computer which only a few years back required skilled computer operators and technicians. As a result, the computer industry is applying a substantial portion of its resources into making the human-computer interfaces more friendly and comfortable for the user. In this connection the mouse, which has been the primary input device to computers for a generation, is still considered a physically awkward input device, as are all analogous orthogonally movable user input means, such as joysticks and rollerball devices. Consequently, there has been considerable effort expended to make such input devices and the cursors which they control more user friendly and less stressful to use. The present invention provides a contribution in this direction.

In computer systems with advanced computer graphics, i.e. those systems using a graphics display controller conventionally implemented on a graphics controller card which supplements the CPU in controlling display functions, the cursor is implemented in the graphics controller card hardware to speed up and make cursor control and interactive movement, e.g. driven by a mouse. The cursor image is stored as a pixel array or bitmap in an area or register separate from the frame buffer where the display screen image is stored. The system tracks the cursor position in a cursor hotspot register also on the graphics controller card. The cursor hotspot is the position defining point or pixel in the cursor image which determines the cursor position, e.g. where the cursor is an arrow, then the point of the arrow or, where the cursor is a cross, the intersection of the lines on the cross. This position is the point on the screen which will be moved as the mouse is moved. The stored cursor image is then superimposed upon the screen image at the hotspot. When the application which is running on the computer needs to change the cursor image, the application modifies or replaces the cursor image through the particular device driver, e.g. if the operating system is a conventional windowing system such as an X Windows system, the cursor change is made through the X Windows driver, whereby the new cursor image is stored in the cursor bitmap register. Because the pixel arrangement of two different cursor images relative to the defined hotspot may be very different, there is likely to be a significant jerk in the cursor movement, as well as a substantial distortion in the cursor image shape when the cursor image is modified or replaced. This is a distraction and an annoyance to the interactive user, particularly when the user is trying to use the cursor for precise and detailed graphics.

SUMMARY OF THE PRESENT INVENTION

The present invention overcomes these deficiencies when changing cursor images by providing apparatus for changing the cursor image in a computer controlled user interactive display system which already comprises a frame buffer for storing the display screen image as a pixel array, as well as a separate display buffer for storing the current cursor image as a pixel array. The invention further provides means for storing an alternate cursor image as a pixel array during the display of the current cursor image, together with means for replacing the current cursor image with the alternate cursor image. Where the display system uses raster scanning means for maintaining the display screen image in the frame buffer on said display screen, the invention provides for means for effecting the replacement of said images during a vertical blanking period in said raster scanning.

Best results are achieved when said buffer for storing said current pixel image is a register with the bitmap of said current cursor image, and said means for storing said alternate cursor image is a register with the bitmap of said alternate cursor image. Then, the system further provides means for selection of one of said cursor images.

When the applications being displayed have more than a current and an alternate cursor image, e.g. three or even more cursor images, then the alternate cursor image being stored while the current cursor image is being displayed may be replaced with yet another cursor image, which then is stored as the alternate cursor image.

BRIEF DESCRIPTION OF THE DRAWINGS

The present invention will be better understood and its numerous objects and advantages will become more apparent to those skilled in the art by reference to the following drawings, in conjunction with the accompanying specification, in which.

DETAILED DESCRIPTION OF THE PREFERRED EMBODIMENT

Figure 1:
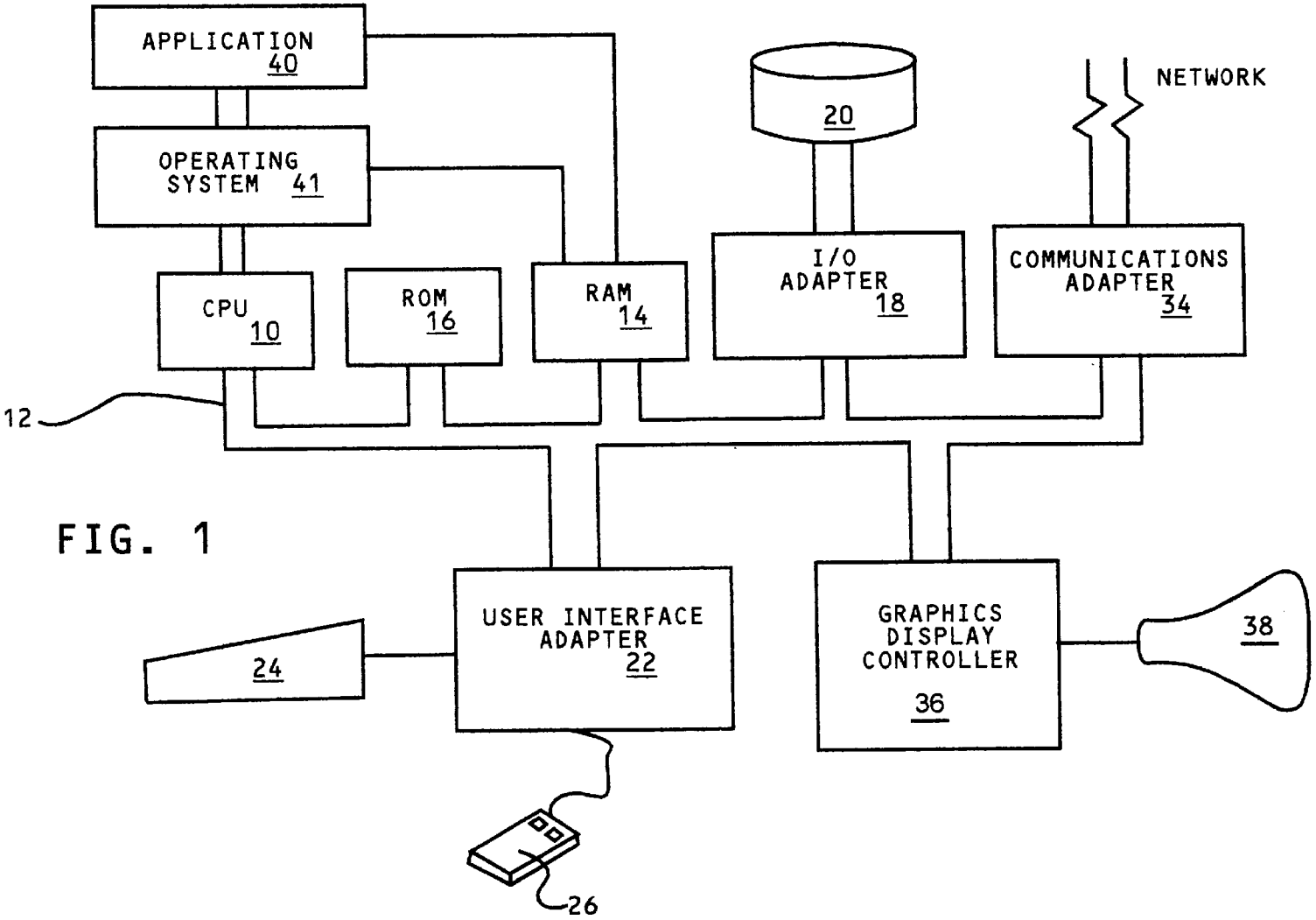
FIG. 1 is a block diagram of a generalized data processing system including the graphics display controller card which will provide the computer controlled interactive display system which may be used to implement smooth transition between alternate cursor images in accordance with the present invention.

Referring to FIG. 1, a typical data processing system is shown which may function as a basic computer controlled display system on which the smooth or uniform transitions between alternate cursor images in accordance with the present invention may be implemented. A central processing unit (CPU) 10, such as one of the PC microprocessors or workstations, e.g. RISC System/6000™ (RISC System/6000 is a trademark of International Business Machines Corporation) series available from International Business Machines Corporation (IBM), is provided and interconnected to various other components by system bus 12. An operating system 41 runs on CPU 10, provides control and is used to coordinate the function of the various components of FIG. 1. Operating system 41 may be one of the commercially available operating systems such as the AIX 6000™ operating system or OS/2™ operating system available from IBM (AIX 6000 and OS/2 are trademarks of International Business Machines Corporation); Microsoft's Windows 98™ or Windows NT™, (Windows 98 and Windows NT are trademarks of Microsoft Corporation), as well as other UNIX and AIX operating systems. Application programs 40 controlled by the system are moved into and out of the main memory, random access memory (RAM) 14. These application programs will require and send calls for alternate cursor images, whereby the transitions between changing cursor images may be smoothly carried out in accordance with the present invention. A read only memory (ROM) 16 is connected to CPU 10 via bus 12 and includes the basic input/output system (BIOS) that controls the basic computer functions. RAM 14, I/O adapter 18 and communications adapter 34 are also interconnected to system bus 12. I/O adapter 18 may be a small computer system interface (SCSI) adapter that communicates with the disk storage device 20. Communications adapter 34 interconnects bus 12 with an outside network enabling the data processing system to communicate with other such systems over a LAN or WAN, which includes, of course, the Web or Internet. I/O devices are also connected to system bus 12 via user interface adapter 22 and display adapter 36. Keyboard 24 and mouse 26 are all interconnected to bus 12 through user interface adapter 22. Graphics display controller 36, usually in the form of a graphics controller card which will be described in detail in FIG. 2, contains the means for storing the alternate cursor image of this invention.

Figure 2:
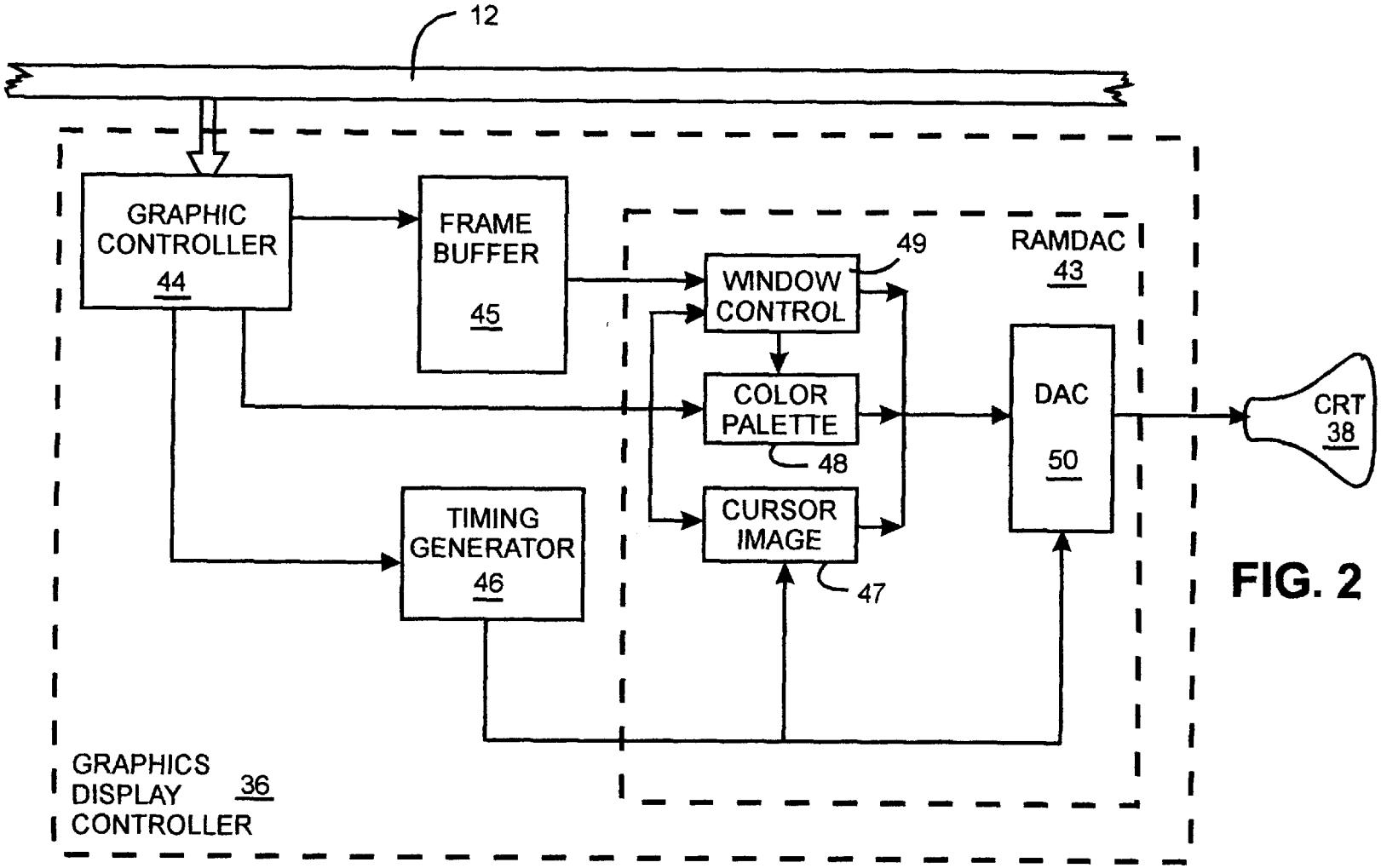
FIG. 2 is a generalized block diagram of the graphics controller system which may be used to implement the present invention.

FIG. 2 shows a graphics display controller 36, which is a presently available graphics display controller modified to include the cursor image system 47 of the present invention. By way of background, substantially all computer systems for handling relatively advanced graphics have a graphics display controller system to function intermediate the CPU of the computer and the cathode ray tube (CRT) screen. The computer operating system determines what is going to be displayed and the graphics display controller does the job of translating what the operating system has put out into a form that the display screen can display. Thus, in the raster scan graphics display of FIG. 2, there is hardware to convert the output of the application in the operating system of the computer of FIG. 1 which is in the form of graphic primitives and other binary data provided on system bus 12 to graphics controller logic 44, under the-control of which the text-graphics image being displayed on the screen is stored as a pixel array image in frame buffer 45. The digital image in the frame buffer is processed through RAMDAC (random access memory digital to analog converter) unit 43 to provide the raster scanned analog image maintained on the screen of CRT 38. RAMDACs are extensively used in advanced raster graphics display systems. RAMDACs are generally described in the text, *Computer Graphics Principles and Practice,* 2d Ed., 1990, James Foley et al., Addison-Wesley Publishers, New York, at pages 860–861. RAMDACs are integrated circuit units operating with frame buffers comprising multiple banks of V-RAMs connected to a shift register. Multiple pixels, one from each VRAM bank, can be loaded into the shift register in parallel and then shifted out serially at the refresh rate of the CRT. The overall RAMDAC unit functions under the control of timing generator 46, and also includes window control 49 for controlling the screen image with respect to the operating system's windows, and color palette control 48 for selecting from the appropriate V-RAM banks to display the screen image in appropriate colors. All of these functions provide an output to DAC (digital to analog converter) 50, which under the control of timing generator 46 provides the analog raster scan needed to maintain and refresh the desired screen images on CRT 38. Cursor image control 47 provides the cursor image to DAC 50 which superimposes the image onto the screen image at the cursor hotspot, also controlled by cursor image control 47. It is in this cursor image control that the present invention for smoothly switching between a plurality of alternate cursor images is carried out. This will now be described with respect to FIG. 3.

Figure 3:
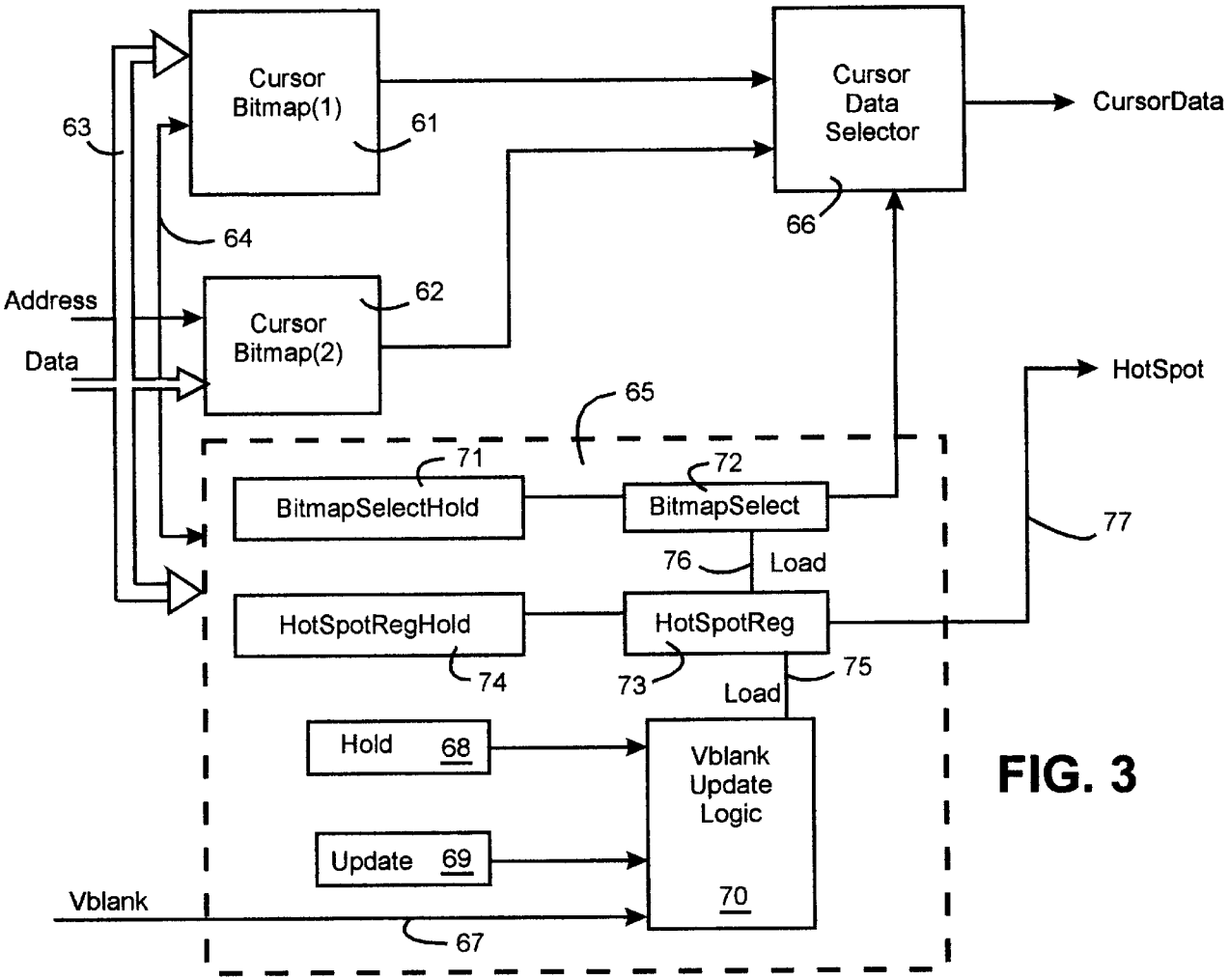
FIG. 3 is a block diagram of the apparatus used to implement the switching between current and alternate cursors according to the present invention.

With reference to FIG. 3, there are two cursor bitmap storage arrays (1), 61 and (2), 62. The cursor images are stored in these arrays, and are, thus, available for alternate use or display on the screen. Thus, the cursor image in one of storage arrays 61 or 62 will be the cursor currently in use but replaceable by the alternate as controlled by cursor data selector 66, as will subsequently be described. It should be noted that the description covers an example in which the new cursor image is written into the nonselected cursor bitmap array, either 61 or 62, and then switched so as to be the current displayed cursor image on the next vertical blanking of the raster scan. This need not always be the case. Two cursor images may be stored in the respective storage arrays 61 and 62 and repeatedly switched back and forth as the current image.

In making a change in cursor image, the new image is written into the cursor storage array 61 or 62 not in current display, addressed via line 64, and the data written via data line 63. New hotspot data for the new cursor is applied via data line 63 to be written into hotspot register 73. However, since no hotspot change may be made until there is a vertical blanking period, when the hotspot change will be made on the display screen is determined by a one bit register: HotSpotRegisterHold, 74; the presence of a bit in this register will serve to hold the application to the screen of the position in the hotspot register until the appropriate blanking, which will hereinafter be described.

Irrespective of when any new cursor image data was written in a storage array 61 or 62, it can only be displayed after there has been a raster scan blanking period. Thus, if a change in cursor image is selected, then this change is written into bitmap select register 72. However, since no change in cursor image may be made on the display screen until there is a vertical blanking period, then when the cursor image change will be made on the display screen is determined by a one bit register: BitmapSelectHold 71; the presence of a bit in this register will serve to hold the cursor image bitmap change in BitmapSelect 72 register until the appropriate blanking, as will hereinafter be described.

VBlank Update Logic 70 operates to apply load signals respectively on lines 75 and 76 to BitmapSelect 72 and HotSpotReg 73 to override the holds which may be applied to these respectively by BitmapSelectHold Register 71 and HotSpotRegisterHold 74 to thereby permit the appropriate cursor image and Hotspot changes. VBlank 67 is a signal to VBlank Update Logic 70, which is applied whenever data going to the display is to be blanked during the raster scan. Whether VBlank Update Logic will put out a load signal is determined by the values of VBlank signal in combination with the bit values in hold 68 and update 69 according to the following table, for example:

If Update 69=0, load signal is never applied to lines 75 and 76.

If Update 69=1, and Hold 68=0, load signal is always applied to lines 75 and 76 to thereby apply the data in BitmapSelect 72 and HotSpotReg 73.

If Update 69=1, and Hold 68=1, load signal is applied to lines 75 and 76 whenever there is a VBlank 67 signal.

For an example based on this table, let us assume that Cursor Bitmap 61 is the current cursor. If there is to be a change to Cursor Bitmap 62, a "1" bit is applied to hold register 68, a "1" bit is applied to update register 69 and the new cursor bitmap is written into Cursor Bitmap 62. The changed hotspot value for the new cursor is written into hotspot register 73 and a bitmap selection bit is written into bitmap select register 72. Then a "1" is written into update register 69. As a result, during the next vertical blanking time, a signal on line 67 will prompt VBlank update logic to apply a load signal on lines 75 and 76, which in turn will result in cursor bitmap 62 being selected as the cursor image and the new hotspot value in register 73 being applied to the display screen during subsequent display without any cursor jumping or distortion during the transition.

Figure 4:
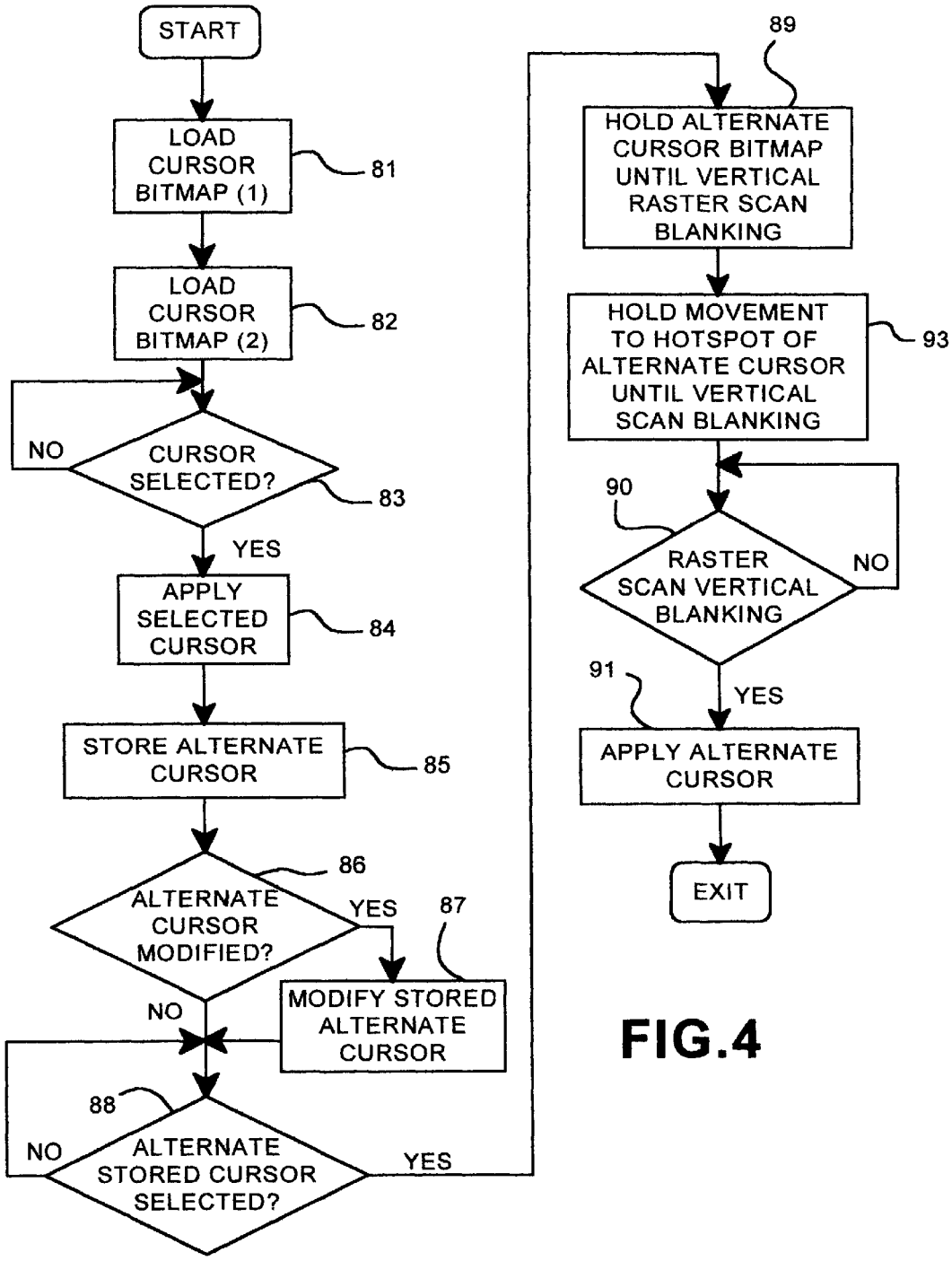
FIG. 4 is a generalized flowchart of the steps which may be followed in changing between several cursor images in accordance with the present invention.

The present invention may be applicable to any display system where a cursor with at least two alternate images may be used. A flowchart of a generalized application of the invention to any system having two stored cursor images will now be described with respect to FIG. 4. The bitmap images of two cursors are stored, steps 81 and 82. Let us assume that one cursor image has initially been selected and is in use through an initial selection step 83 and application to the display screen step 84. The alternate or nonselected cursor image continues to be stored, step 85. During the operation, a third cursor image may be needed. This is determined through decision step 86, i.e. if a third cursor image is required, the stored alternate cursor image will be modified or replaced to provide this new third cursor image. In either case, at some point, either concurrently with the modification of the alternate stored cursor image or at a subsequent point when the alternate cursor is selected for display, step 88, then, as described above, the display of the stored alternate cursor bitmap is held until the next vertical scan blanking, step 89, and movement to the hotspot of the alternate cursor is held until the next vertical scan blanking, step 93. Thus, when vertical scan blanking does occur, step 90, the alternate cursor image is displayed at its updated hotspot, step 91.

Although certain preferred embodiments have been shown and described, it will be understood that many changes and modifications may be made therein without departing from the scope and intent of the appended claims.

What is claimed is:

1. In a computer controlled user interactive display system with a cursor user interactively movable on a display screen, apparatus for changing the cursor image comprising:

a frame buffer for storing the display screen image as a pixel array;

a separate display buffer for storing the current cursor image as a pixel array;

another separate display buffer for storing an alternate different cursor image as a pixel array during the display of the current cursor image; and means for selectively replacing the current cursor image with the alternate cursor image.

2. The computer controlled display system of claim 1 further including:

raster scanning means for maintaining the display screen image in said frame buffer on said display screen; and means for effecting the replacement of said cursor images during a vertical blanking period in said raster scanning.

3. The computer controlled display system of claim 2 further including means for loading an alternate cursor image into said another separate display buffer for storing said alternate image during the display of the current cursor image.

4. The computer controlled display system of claim 3 wherein:

said buffer for storing said current pixel image is a register with the bitmap of said current cursor image, and said another separate display buffer for storing said alternate cursor image is a register with the bitmap of said alternate cursor image, and, further including, means for selection of one of said cursor images.

5. The computer controlled display system of claim 4 further comprising graphics display controller apparatus including said apparatus for changing the cursor image.

6. The computer controlled display system of claim 5 wherein said graphics display controller apparatus further includes RAMDAC apparatus for converting the images stored in the frame buffer and in the current cursor image buffer to an analog state for the raster scanning.

7. The computer controlled display system of claim 1 wherein:

said buffer for storing said current pixel image is a register with the bitmap of said current cursor image, and said buffer for storing said alternate cursor image is a register with the bitmap of said alternate cursor image, and further including, means for selection of one of said cursor images.

8. The computer controlled display system of claim 2 further comprising graphics display controller apparatus including said apparatus for changing the cursor image.

9. The computer controlled display system of claim 8 wherein said graphics display controller apparatus further includes RAMDAC apparatus for converting the images stored in the frame buffer and in the current cursor image buffer to an analog state for the raster scanning.

10. In a computer controlled user interactive display system with a cursor user interactively movable on a display screen with a screen image, a method for changing the cursor image comprising:

storing the display screen image as a pixel array in a frame buffer;

storing, in a display buffer separate from the stored screen image, the current cursor image as a pixel array;

storing, in another separate display buffer, an alternate different cursor image as a pixel array during the display of the current cursor image; and selectively replacing the current cursor image with the alternate cursor image.

11. The method of claim 10 further including the steps of:

raster scanning to maintain the display screen image on said display screen; and effecting the replacement of said cursor images during a vertical blanking period in said raster scanning.

12. The method of claim 11 further including the step of forming the alternate stored cursor image during the display of the current cursor image.

13. The method of claim 11 wherein:

said current cursor pixel image is a bit-map of said current cursor image, and said alternate cursor image is a bitmap of said alternate cursor image, and, further including, the step of selecting one of said cursor images.

14. The method of claim 13 further including the steps of:

converting the stored screen image and the stored current cursor image into analog states for said raster scanning.

* * * * *